US007717802B2

(12) United States Patent
Christensen

(10) Patent No.: US 7,717,802 B2
(45) Date of Patent: May 18, 2010

(54) PUTTING TRAINING DEVICE AND METHOD

(76) Inventor: Chris A. Christensen, 6613 Victoria Ave., North Richland Hills, TX (US) 76180-8113

( * ) Notice: Subject to any disclaimer, the term of this patent is extended or adjusted under 35 U.S.C. 154(b) by 0 days.

(21) Appl. No.: 11/966,440

(22) Filed: Dec. 28, 2007

(65) Prior Publication Data

US 2009/0170623 A1 Jul. 2, 2009

(51) Int. Cl.
*A63B 69/36* (2006.01)

(52) U.S. Cl. ..... 473/261; 473/218; 473/272

(58) Field of Classification Search ..... 473/150, 473/173, 174, 257, 261–264, 265, 266, 278, 473/279, 218, 270, 272
See application file for complete search history.

(56) References Cited

U.S. PATENT DOCUMENTS

| | | | | | |
|---|---|---|---|---|---|
| 2,801,857 | A | | 8/1957 | Strunk | |
| 3,194,565 | A | | 7/1965 | Schroer | |
| 3,741,550 | A | | 6/1973 | Landures | |
| 3,920,248 | A | * | 11/1975 | Medders | 473/218 |
| 4,023,811 | A | | 5/1977 | DeCota | |
| 4,465,281 | A | | 8/1984 | Whitfield | |
| 4,583,739 | A | * | 4/1986 | Kabbany | 473/218 |
| 4,659,125 | A | * | 4/1987 | Chuan | 294/19.2 |
| 4,732,390 | A | | 3/1988 | McCollum | |
| 5,376,054 | A | * | 12/1994 | Kwasny et al. | 473/40 |
| D407,773 | S | | 4/1999 | Greig | |
| D462,734 | S | | 9/2002 | Pelz | |
| 6,503,152 | B1 | | 1/2003 | Pelz | |
| 6,537,156 | B1 | * | 3/2003 | Stagg | 473/40 |
| 6,726,576 | B1 | * | 4/2004 | Froggatte | 473/270 |
| 6,786,833 | B2 | | 9/2004 | Ahrend | |
| 6,923,730 | B1 | | 8/2005 | Potter | |
| 7,001,285 | B1 | | 2/2006 | Ahrend | |
| 2006/0019764 | A1 | | 1/2006 | Gegelys | |

OTHER PUBLICATIONS

International Search Report dated Feb. 19, 2009, for application No. PCT/US2008/088298, filed Dec. 24, 2008, Chris A. Christensen, 8 pages.

* cited by examiner

*Primary Examiner*—Nini Legesse
(74) *Attorney, Agent, or Firm*—Geoffrey A. Mantooth; Brian K. Yost

(57) ABSTRACT

The putting training device positions a plurality of objects and a practice ball on a practice surface, and, in the preferred embodiment, comprises an arm arrangement of two connected rods having telescoping ball receptacles at each end. Four golf balls contained within perimeter receptacles are guiding balls. A golf ball positioned within a fifth receptacle is a practice ball to be putted once the putting training device is removed from the five positioned golf balls. The method comprises: providing an alignment device comprising; two ball sockets that define a take-away gap; two ball sockets that define a follow-through gap; the take-away gap and follow through gap further defining a putting arc distance gap; placing a plurality of objects on a putting surface; overlaying the alignment device on the objects so that the sockets contain an object; and removing the device, thereby leaving the objects on the putting surface.

8 Claims, 6 Drawing Sheets

PUTTING TRAINING DEVICE AND METHOD

BACKGROUND OF THE INVENTION

1. Field of the Invention

The present invention relates to a putting training device and method.

2. Description of the Prior Art

Golf, a game played for centuries, has achieved worldwide popularity. It is thought that as many as 60 million people play golf across the globe on a total of 32,000 golf courses. The United States alone accounts for over half these numbers. With all of golf's popularity, it is the rare person indeed who does not encounter frustration while playing the game. While delight and indescribable contentment may result from seeing the ball hone in on the flagstick after a perfectly executed stroke, frustration surely results from the cold vibration and wayward path of the golf ball poorly struck. In an effort to eliminate, or at least minimize, frustration, the golfer seeks refuge in golf books, magazines, videos, private instruction, and hours of practice. But each aspect of the game presents its own challenges. For example, in driving the ball from a tee, the club head may reach a speed in excess of 100 miles per hour. Coordinating this explosion of energy with sufficient accuracy is exceedingly difficult for even the professional golfer. In most cases, the weekend golfer lacks the physical ability to match the distance and accuracy of the professional.

Similarly, approach shots to the green often require a great deal of arc and backspin in order for the ball to land close to the hole or even remain on the green. Because weekend golfers often drive the ball a shorter distance, they must use a less lofted club on approach shots in order to reach the green, resulting in less accuracy and more frustration. Thus, the gap widens between the weekend golfers' golf games and that of their professional counterparts.

Putting, on the other hand, does not demand explosive energy, high club head speed, or a great deal of manual dexterity. Rather, putting requires proper technique, alignment, and concentration. Accurate putting, more than any other shot in golf, may be mastered by almost all that play the game. And because putting may account for almost half the number of total strokes in a round of golf, it is this area of golf in which high handicap golfers may narrow the gap between themselves and professionals.

Just as in other golf strokes, the putting stroke involves a take-away, a forward stroke, and a follow-through. The distance the putter head travels between the forward stroke and follow-through, the stroke length, is important for determining the distance the putt travels. The distance the putter head travels along the target line between the forward stroke and follow-through determines putting consistency. This distance is determined by a number of factors, including the golfer's size, flexibility, and training. Generally, a longer putting arc distance correlates positively with greater accuracy and consistency. While a number of putting training aids and methods are known in the art, none provide the necessary training or assistance for a golfer to attain the optimum putting arc distance. Some devices known in the art are mats that must be placed on a surface. Such mats, however, are necessarily unnatural and artificial. Putting on a mat alters the spatial relationship between the golfer and the putting surface as well as interferes with the golfer's "feel" that may only be attained from putting on a natural surface. Other devices known in the art must remain on the putting surface during practice which, again, interferes with the golfer's ability to practice effectively.

What is needed is a device and method that may be comfortably and effectively used by golfers to develop an optimum putting arc distance and improve putting.

SUMMARY OF THE INVENTION

It is an object of the present invention to provide a device and method to improve putting. The present invention provides such a device and method.

The present invention provides a putting training device that positions a plurality of objects on a putting surface. The device comprises an arm arrangement and a plurality of sockets coupled to the arm arrangement. Each of the sockets is capable of individually nesting a respective one of the objects. The arm arrangement has a positioner for locating a practice ball on the putting surface. The sockets define a take-away gap relative to the positioner and a follow-through gap relative to the positioner, as well as a putting arc distance between the take-away gap and the follow-through gap. The distance between the sockets is adjustable so that the take-away gap, the follow-through gap and the putting arc distance can be adjusted.

In accordance with one aspect of the present invention, the arm arrangement comprises two arms that are coupled together in an "X" shape.

In accordance with another aspect of the present invention a socket is positioned at each end of the "X".

In accordance with another aspect of the present invention the device has an adjustable angle between the arms.

In accordance with another aspect of the present invention, each one of the sockets is coupled to the arm arrangement by a telescoping arrangement.

In accordance with another aspect of the present invention, the positioner further comprises a socket capable of receiving the practice ball.

In accordance with another aspect of the present invention, the objects are balls.

In accordance with another aspect of the present invention the objects are golf balls.

In accordance with another aspect of the present invention, the arm arrangement comprises two arms that are coupled together in an "X" shape. A socket is positioned at each end of the "X". The device has an adjustable angle between the arms. Each one of the sockets is coupled to the arm arrangement by a telescoping arrangement. The positioner further comprises a socket capable of receiving the practice ball. The objects are golf balls.

The present invention also provides a method to improve putting comprising the steps of providing an alignment device comprising; two object sockets that define a take-away gap; two object sockets that define a follow-through gap; the take-away gap and follow-through gap being separated by a putting arc distance gap. A plurality of objects is placed on a putting surface. A target ball is placed on the putting surface, Overlaying the alignment device on the objects so that the respective sockets contain one of the objects and positioning the target ball within the objects. Removing the device, thereby leaving the objects and the target ball on the putting surface.

In accordance with another aspect of the present invention the step of overlaying the alignment device on the objects and positioning the target ball further comprises the step of using the alignment device to position the target ball.

In accordance with another aspect of the present invention the method further comprises the step of adjusting the take-away gap and the follow-through gap.

In accordance with another aspect of the present invention the method further comprises the step of adjusting the putting arc distance.

DESCRIPTION OF THE PREFERRED EMBODIMENT

The device of the present invention accurately and easily positions balls on a putting or practice surface, which may be a practice green, artificial turf, carpet or the like. The device positions a target ball which is to be struck by a putter club. The device also positions outlying balls. The outlying balls define gaps 11, 12 for the putter head to travel through as the putter head is moved through its stroke. The outlying balls also define a putting arc distance 15, which is the distance the putter head travels during the stroke. The gaps 11, 12 and putting arc distance 15 may be adjusted. For example, a taller golfer may have a greater putting arc distance than a shorter golfer. The gaps 11, 12 may be adjusted to accommodate differences in putter head size as well as differences in skill levels. Because of skill differences, a more accomplished golfer may prefer a narrower gap 11, 12, even with the same size putter, than an inexperienced golfer.

Figure 1:
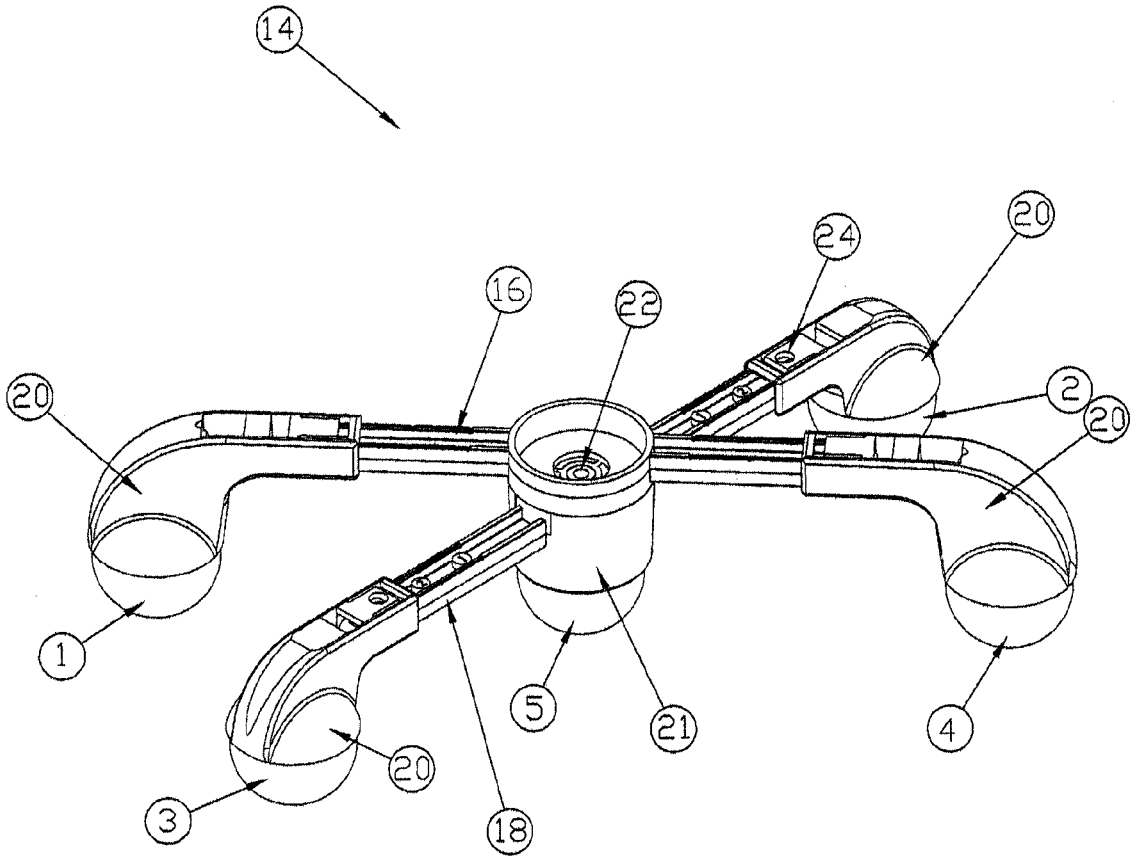
FIG. 1 is a perspective view of the putting training device of the present invention in accordance with one embodiment.
Figure 2:
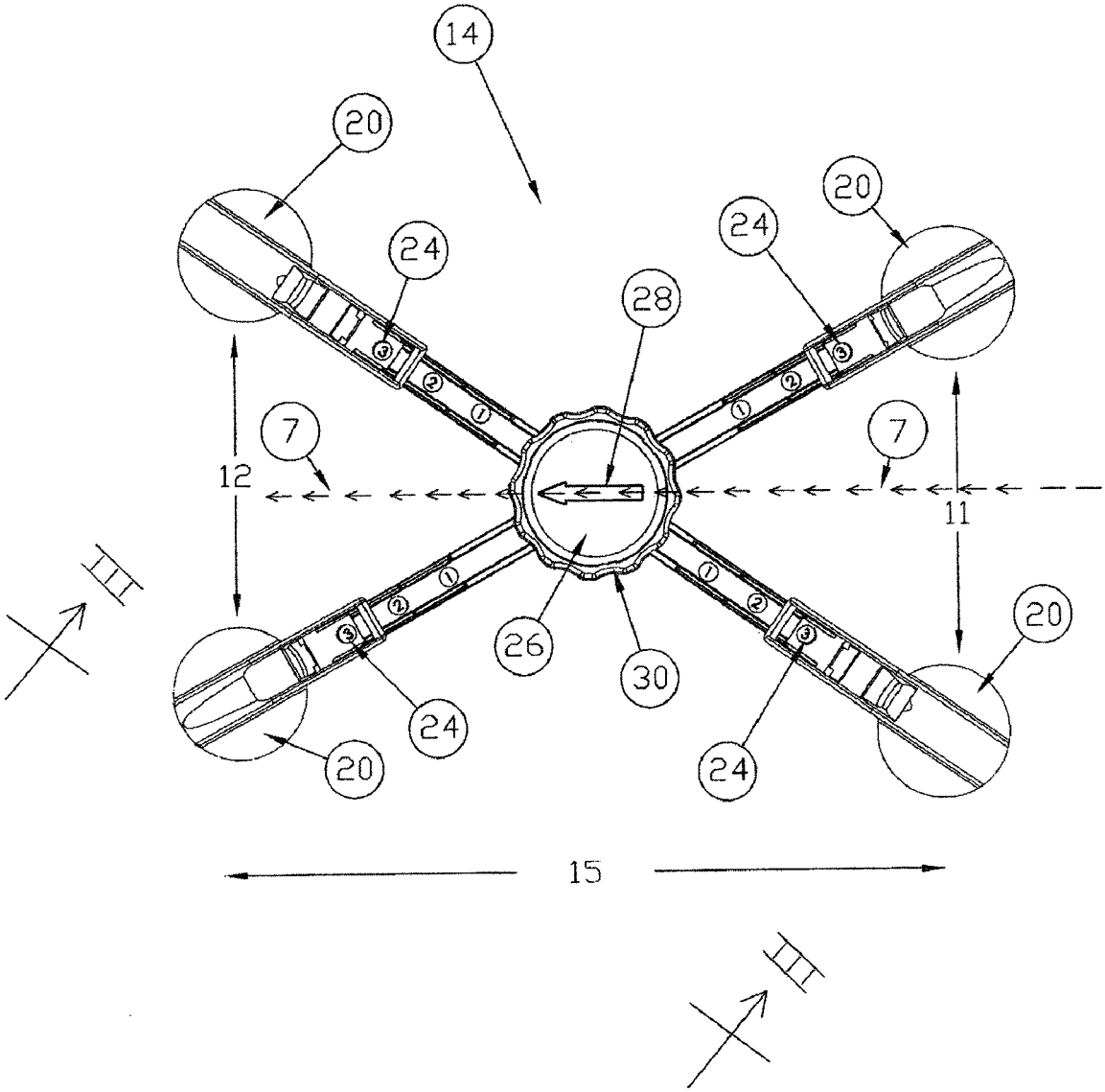
FIG. 2 is a top view of the putting training device of the present invention in accordance with another embodiment.
Figure 3:
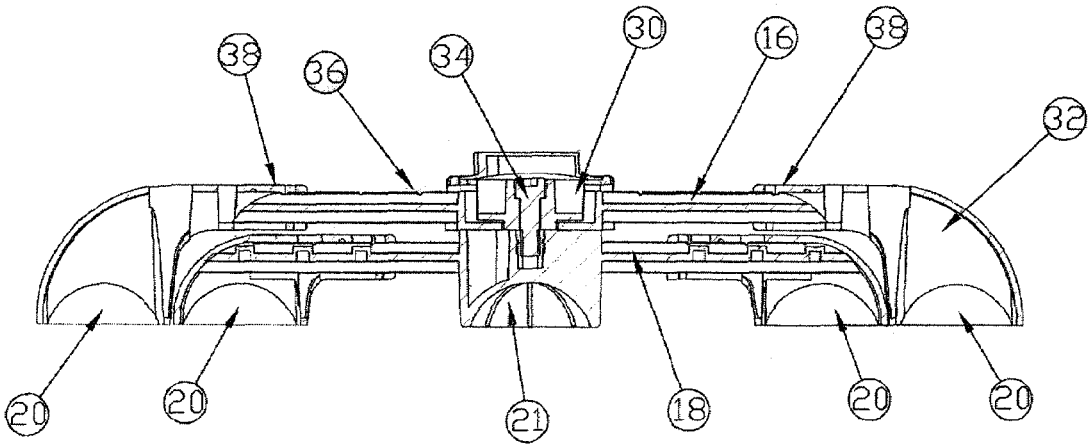
FIG. 3 is a side elevational view of the putting training device of FIG. 2, taken along lines III-III, with the rods and receptacles shown in partial cross-section.

Referring to FIGS. 1-3, the putting training device 14 of the present invention may be used to position a plurality of practice balls 1-5 on a practice surface in a pattern. The putting training device 14 comprises an arm arrangement 16, 18 having telescoping ball perimeter receptacles, or sockets 20 at each end, and a practice ball receptacle, or positioner, 21 near the center of the device. The arm arrangement of the preferred embodiment comprises two connected rods, or arms 16, 18. In the preferred embodiment, these arms 16, 18 and receptacles 20, 21 are made of polycarbonate and the perimeter, or outlying, receptacles 20 telescope to permit adjustment. However, the rods 16, 18 and receptacles 20, 21 need not be made of polycarbonate, but may be constructed of aluminum, steel or other suitable material, and the perimeter receptacles 20 need not telescope, but rather, may be adjusted in a number of ways. For example, in another embodiment, the receptacles 20 that nest, or receive, the perimeter balls 1-4 may slide along the length of the rods 16, 18 rather than telescope.

The rods 16, 18 are pivotally connected at the approximate midpoint of each rod 16, 18 at a pivot point 22 such that the rods 16, 18 form an "X" configuration and may move in a scissor-like fashion. Each receptacle 20, 21 contains a socket or cavity that allows a standard golf ball 1-4 to nest within it. A fifth receptacle 21 is located directly below the pivot point 22 of the two rods 16, 18, and also contains a cavity in which a golf ball 5 may nest. The four golf balls 1-4 contained within the perimeter receptacles 20 are the guiding balls 1-4. The golf ball 5 positioned within the fifth receptacle 20 is the practice, or target, ball 5 to be putted once the putting training device 14 is removed from the five positioned golf balls 1-5.

The putting training device 14 may be adjusted so that the gaps 11, 12 (See FIG. 4) between the pairs 1, 3 and 2, 4 of guiding balls 1-4 may be narrowed or widened. Referring to FIG. 1, in one embodiment, the arms 16, 18 are joined at the pivot point 22 by a pin. In this embodiment, there is friction upon movement of the arms 16, 18 relative to one another, and this friction maintains the arms in the desired position. In another embodiment, and as shown in FIG. 3, a post 34 is coupled with the lower rod 18 at the pivot point. This post 34 transects the upper rod 16 at the pivot point 22 and is threaded at the upper protruding end to which an adjustment knob 30 may be threadedly attached. The adjustment knob 30 has an arrow 28 within its perimeter that rotates independently of the knob 30. The gaps 11, 12 may be adjusted by loosening the adjustment knob 30 at the pivot point 22, positioning the perimeter sockets 20 to the desired gap 11, 12 distance, and re-tightening the knob 30. Because of the scissor action, adjusting the take-away gap 11 (see FIG. 4) results in a corresponding adjustment of the follow-through gap 12.

Figure 5:
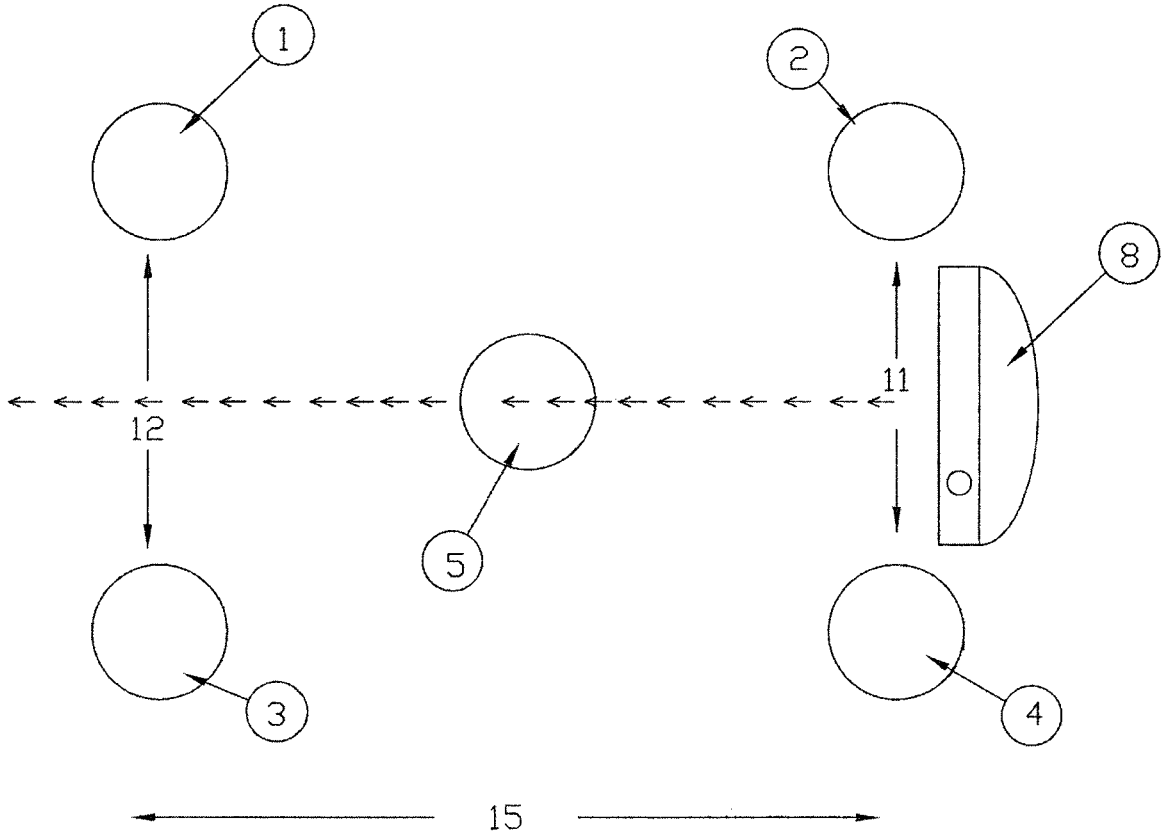
FIG. 5 is a top view of the golf balls of FIG. 4 positioned in a pattern in accordance with the method of the present invention and showing a putter head positioned within the pattern.

When the golfer swings the putter, the putter head 8 naturally swings in an arc. The putting arc distance 15 is the straight line section of the arc swing. The putting training device provides a take-away gap 11 and a follow-through gap 12, which gaps are separated by the putting arc distance 15, as shown in FIGS. 2 and 5. The putting arc distance 15 of the device may be adjusted by extending or contracting the receptacles 20 at the end of each arm 16, 18 as well as changing the relative angles between the receptacles 20. As may be seen in FIG. 2, in the preferred embodiment, each perimeter receptacle, or socket, telescopes and is secured in position relative to the rods 16, 18 by the elastic properties of the polycarbonate. Thus, the receptacles 20 may be positioned either closer to or further from the pivot point 22. Referring to FIG. 3, in another embodiment of the present invention, the receptacles 20 may be adjusted to pre-determined settings 24 by a retaining mechanism comprising of a projection/detent system. In the preferred embodiment, the receptacle has a leaf spring mounted projection 38 that is received by detents 36 in the respective rod. As shown in FIG. 2, the pre-determined settings are denoted as "1", "2" and "3". Such adjustments result in an increase or decrease in the distance between the first pair 2, 4 of balls and the second pair 1, 3 of balls. This increased distance between the first pair 2, 4 and second pair 1, 3 increases the distance the putter head 8 must travel along the target line 7. This is the putting arc distance 15. By way of example, the proper setting for a child may be the "1" position, while a taller adult golfer's setting may be "3".

Figure 4:
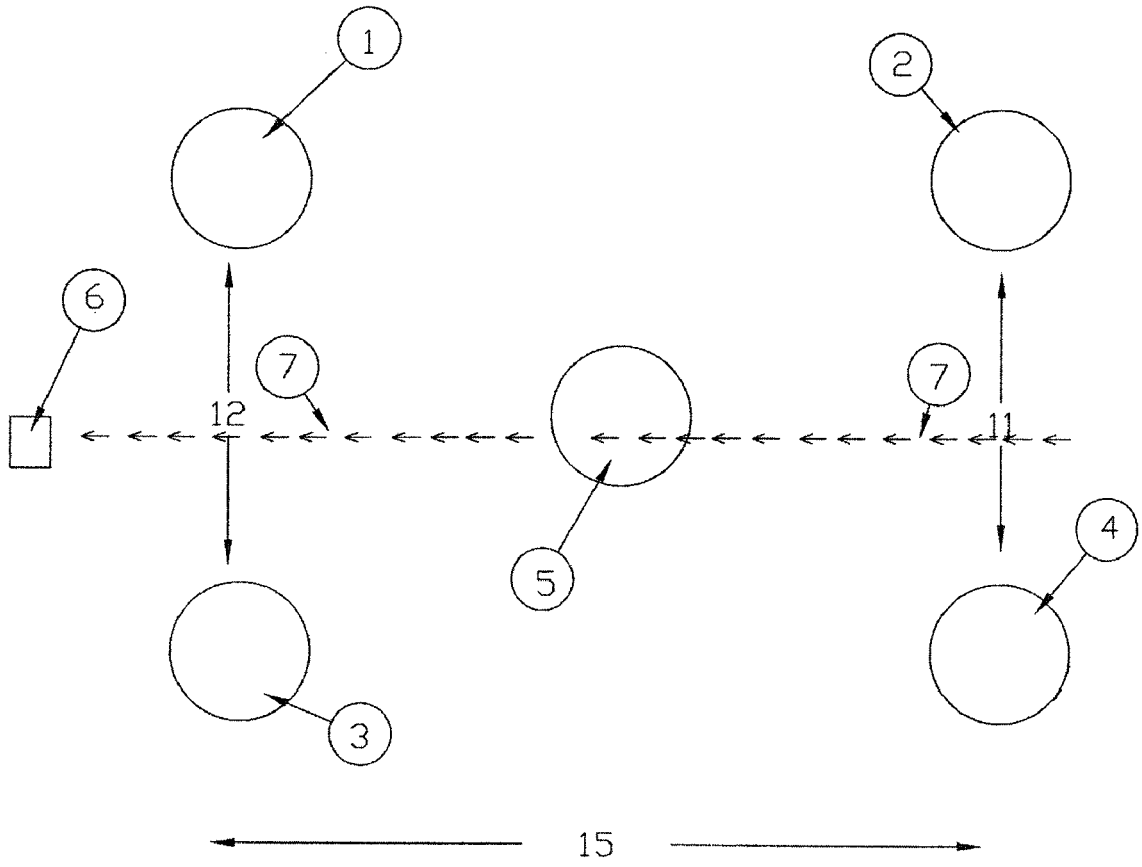
FIG. 4 is top view of golf balls positioned in a pattern with the putting training device in accordance with the method of the present invention.
Figure 6:
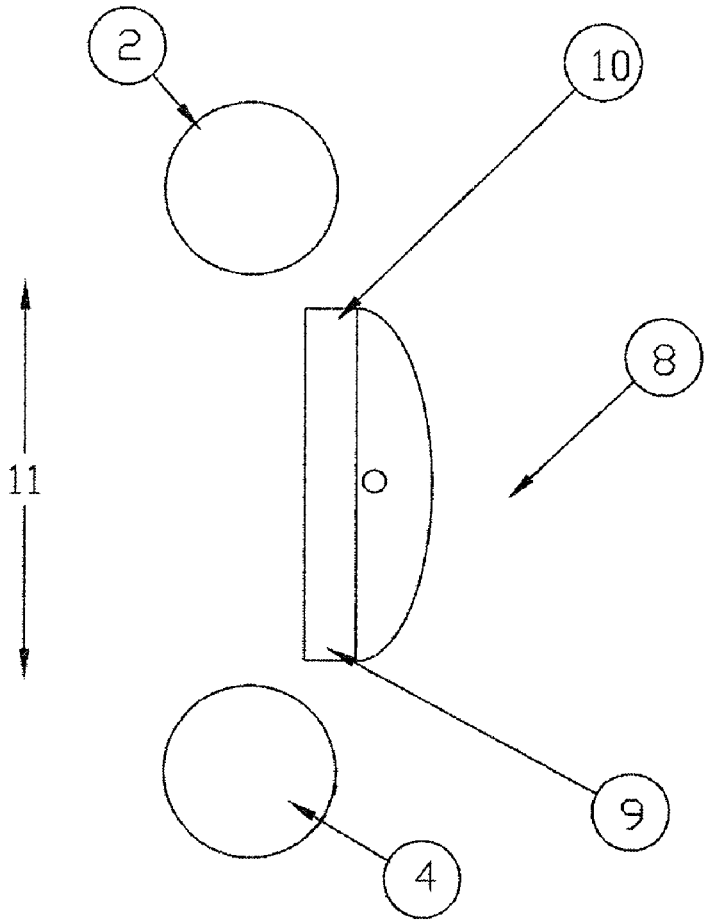
FIG. 6 is a top view of the first pair of golf balls forming the take-away gap.

Referring to FIGS. 4 and 5, a plurality of objects 1-4 and a practice ball 5 are positioned on a putting surface. In the preferred embodiment, the objects 1-4 are golf balls. The golf balls 1-5 are positioned on the putting surface in a pattern such that the practice ball 5 is placed at a desired distance from the hole or target 6. The imaginary line bisecting the target and practice ball is the target line 7. This line 7 represents the intended imaginary path upon which the practice ball 5 will travel after being struck by the putter head 8. Of course, the path is imaginary, because the actual path taken by the putted ball 5 may or may not be straight because of contours of the surface. A first pair of practice balls ("first pair") 2, 4 is placed on the practice surface. This first pair 2, 4 is positioned so that the practice ball 5 lies between the first pair 2, 4 and the target 6. The balls of the first pair 2, 4 are spaced apart from one another so as to create a take-away gap 11 bisected by the target line 7. Referring to FIGS. 5 and 6, the take-away gap 11 is slightly wider than the length of the putter head 8 as measured from heel 9 to toe 10. The take-away gap 11 is the gap in which the putter head 8 travels at the first movement of the putter head 8 away from the practice ball 5 and on the forward stroke before striking the practice ball 5.

Between the practice ball 5 and the target 6, a second pair 1, 3 of practice balls ("second pair") is placed on the putting surface. The balls of the second pair 1, 3 are spaced apart from one another so as to create a follow-through gap 12 bisected by the target line 7. The follow-though gap 12 is slightly wider than the length of the puffer head 8 as measured from heel 9 to toe 10. The follow-through gap 12 is the gap through which the putter head 8 travels after striking the practice ball 5. The follow-through gap 12 is typically the same size as the take-away gap 11, but need not be so.

To practice the method of the present invention, the golfer, after addressing the practice ball 5 with the putter head 8, moves the putter head 8 away from the practice ball 5 and through the take-away gap 11 along the target line 7. The golfer then moves the putter head 8 toward the practice ball 5 along the target line 7 through the take-away gap 11 so as to strike the practice ball 5 along the target line 7. After striking the target ball 5 with the putter head 8, the golfer then, in accordance with the method of the present invention, moves the putter head 8 through the follow-through gap 12 along the target line 7. When the putting stroke is executed properly, the putter head 8 will only strike the target ball 5.

The operation and use of the putting training device 14 of the preferred embodiment will now be described. The device 14 assists a golfer no matter what the golfer's skill level might be. For a less experienced golfer, the device helps to determine the natural stroke, as well as the center of the arc stroke. The device is used to position on the putting surface the outlying balls 1-4, as well as the target ball 5. The golfer positions the putter head at the target ball 5 and makes a putting stroke. If the putter head hits one or more of the outlying balls 1-4, the putting arc distance can be changed. For example, the putting arc distance can be shortened by telescoping the sockets 20 inwardly toward the target ball. Conversely the putting arc distance 15 can be increased to increase the distance and time the putter head travels down the path 7. The two gaps can be adjusted by the scissor type motion of the rods 16, 18.

Once the putting arc distance 15 is established, the use of the socket 21 is not needed every time the golfer positions the target ball 5. In fact, the device need not be used again unless one of the outlying balls 1-4 has been struck, or the setup is to be changed. The golfer can manually locate the target ball 5 in the center, or to the right or left of center.

With a more experienced golfer, the golfer may determine a desired putting arc distance 15, extend the receptacles 20, and adjust the angles between the receptacles 20 so that the take-away gap 11 and follow-through gap 12 correspond with the predetermined putting arc distance 15. The golfer then places golf balls 1-5 on the putting surface and places the putting training device 14 over the balls 1-5 so that a ball 1-5 nests within the cavity of each receptacle 20, 21. The golfer then turns the dial arrow 28 so that it points along an imaginary line bisecting the take-away gap 11, the follow-through gap 12, and the practice ball 5. The golfer then turns the putting training device 14 with the balls 1-5 still nested within the receptacle 20, 21 cavities, so that the arrow 28 points along the target line 7. The golfer then removes the putting training device from the golf balls, leaving the golf balls resting on the putting surface. The golfer, after addressing the practice ball 5 with the putter head 8, moves the putter head 8 away from the practice ball 5 and through the take-away gap 11 along the target line 7. The golfer then moves the putter head 8 toward the practice ball 5 along the target line 7 through the take-away gap 11 so as to strike the practice ball 5 along the target line 7. After striking the target ball 5 with the putter head 8, the golfer then moves the putter head 8 through the follow-through gap 12 along the target line 7. When the putting motion is executed properly, the putter head 8 will strike only the target ball 5.

The above description relates to a preferred embodiment of the present invention, however, there are many other potential embodiments of the invention. For instance, in the preferred embodiment, the arm arrangement of the device 14 is "X" shaped. However, the arm arrangement need not be "X" shaped. In another embodiment of the present invention, the arm arrangement may be "H" shaped. In such an embodiment, the receptacles 20, 21 may be positioned at the end of each "H" leg and below the center of the "H" crossbar. In such an embodiment, the take-away 11 and follow-through 12 gaps are determined by the width of the "H", which is adjustable. The putting arc distance 15 is determined, in this alternative embodiment, by the length of the "H", which is adjustable.

Further, in the preferred embodiment, the arms 16, 18 comprising the arm arrangement are secured in position by a threaded knob 30. However, the arms need not be so secured. In another embodiment of the invention, the arms are maintained in position by a spring which exerts the clamping force between the arms to bring them together. In this embodiment, the upper arm 16 is turned with the adjustment knob 30 to a desired position. Upon release of the adjustment knob 30, the spring maintains downward force on the upper arm 16, thus maintaining the arms 16, 18 in their relative positions. Gear-like rings with detents can be used, wherein adjusting the angle between the arms involves clicking from one detent to the next.

In the preferred embodiment 14, the perimeter objects 1-4 are golf balls 1-4, however, the objects 1-4 need not be golf balls. Instead the objects 1-4 may be in virtually any shape and made from virtually any material.

Although in the preferred embodiment the device has a fifth socket 21 for the practice ball, such a socket is not needed. Instead, this socket may be replaced with a positioner, such as a tee peg or other marking device which denotes the position for the practice ball 5.

Therefore, the foregoing disclosure and showings made in the drawings are merely illustrative of the principles of this invention and are not to be interpreted in a limiting sense. The scope of the invention is to be determined from the claims.

I claim:

1. A putting training device that positions a plurality of objects on a putting surface, the device comprising:

a) an arm arrangement comprised of a plurality of arms;

b) a plurality of sockets comprised of first through fourth sockets coupled to the arm arrangement, each of the sockets capable of individually nesting a respective one of the objects;

c) the arm arrangement having a positioner for locating a practice ball on the puffing surface;

d) the second and fourth sockets defining a take-away gap relative to the positioner, the first and third sockets defining a follow-through gap relative to the positioner, wherein a putting arc distance is defined between the take-away gap and the follow-through gap, wherein said positioner is located between the take-away gap and the follow-through gap, the arm arrangement being adjustable such that an angle between the arms may be changed and a distance between said sockets and the positioner may be changed so that the take-away gap, the follow-through gap and the putting arc distance can be adjusted.

2. The putting training device of claim 1, wherein the arm arrangement comprises two arms that are coupled together in an "X" shape.

3. The puffing training device of claim 2, wherein a socket is positioned at each end of the "X".

4. The puffing training device of claim 1, wherein each one of the sockets is coupled to the arm arrangement by a telescoping arrangement.

5. The putting training device of claim 1, wherein the positioner further comprises a socket capable of receiving the practice ball.

6. The putting training device of claim 1, wherein the objects are balls.

7. The puffing training device of claim 1, wherein the objects are golf balls.

8. The putting training device of claim 1, wherein:

a) the arm arrangement comprises two arms that are coupled together in an "X" shape;

b) a socket is positioned at each end of the "X";

c) each one of the sockets is coupled to the arm arrangement by a telescoping arrangement;

d) the positioner further comprises a socket capable of receiving the practice ball; and e) the objects are golf balls.

* * * * *